US006354912B1

(12) United States Patent
Osada et al.

(10) Patent No.: US 6,354,912 B1
(45) Date of Patent: Mar. 12, 2002

(54) WORKPIECE CUTTING METHOD FOR USE WITH DICING MACHINE

(75) Inventors: Masateru Osada; Masayuki Azuma; Hirofumi Shimoda, all of Mitaka (JP); Felix Cohen, Gush Segev (IL)

(73) Assignees: Tokyo Seimitsu Co., Ltd., Mitaka (JP); Kulicke & Soffa Investments, Inc., Wilmington, DE (US)

( * ) Notice: Subject to any disclaimer, the term of this patent is extended or adjusted under 35 U.S.C. 154(b) by 0 days.

(21) Appl. No.: 09/203,611

(22) Filed: Dec. 2, 1998

(30) Foreign Application Priority Data

Dec. 2, 1997 (JP) ..... 9-332159

(51) Int. Cl.[7] ..... B28D 1/04
(52) U.S. Cl. ..... 451/41; 125/13.01
(58) Field of Search ..... 451/41, 57; 125/13.01, 125/35

(56) References Cited

U.S. PATENT DOCUMENTS 6,142,138 A * 11/2000 Azuma et al. ..... 125/13.01
6,155,247 A * 12/2000 Akram et al. ..... 125/23.01

FOREIGN PATENT DOCUMENTS

| | | |
|---|---|---|
| JP | 8-25209 | 1/1996 |
| JP | 11-26402 | 1/1999 |

* cited by examiner

*Primary Examiner*—Robert A. Rose
(74) *Attorney, Agent, or Firm*—Nixon Peabody LLP; David S. Safran

(57) ABSTRACT

Two blades are arranged oppositely at a predetermined interval along the Y-axis. The two blades cut a wafer along two cutting lines at the same time while the two blades are moving along the X-axis. After the wafer is cut along these two cutting lines, the two blades are moved along the Y-axis by one pitch of the cutting lines so that the wafer can be cut along the next two cutting lines. This action is repeated to cut the wafer along the cutting lines continuously. This wafer cutting method can hold the movement of the blades along the X-axis to a minimum because of the oppositely-arranged two blades. Consequently, the wafer can be cut in a short period of time.

3 Claims, 9 Drawing Sheets

WORKPIECE CUTTING METHOD FOR USE WITH DICING MACHINE

BACKGROUND OF THE INVENTION

1. Field of the Invention

The present invention relates generally to a workpiece cutting method for use with a dicing machine, and more particularly to a workpiece cutting method for use with a dicing machine which cuts a semiconductor wafer into squares by using a pair of blades.

2. Description of Related Art

In a dicing machine disclosed in Japanese Patent Provisional Publication No. 8-25209, two spindles are arranged parallel to the Y-axis, and two blades attached to the two spindles cut a semiconductor wafer along cutting lines while the two spindles and the semiconductor wafer are moved relatively to one another along the X-axis. One of the two spindles is capable of adjusting the position along the Y-axis. The spindle is moved along the Y-axis by a predetermined amount to shift two blades by one pitch of the cutting lines, thereby cutting the semiconductor wafer along two cutting lines at the same time.

FIG. 9 is a transitional view describing the workpiece cutting method of the above-mentioned dicing machine. As shown in FIG. 9(A), two blades 1, 2 are positioned along the Y-axis at an interval of one pitch of the cutting lines on the wafer W. To cut the wafer W along the cutting lines L1 and L2, the blade 1 at the right side is aligned with the cutting line L1, and the two blades 1, 2 or the wafer W is moved along the X-axis so that the blade 1 can start cutting the wafer W along the cutting line L1 as shown in FIG. 9(B). Then, the blade 2 starts cutting the wafer W along the cutting line L2. The blades 1, 2 or the wafer W is moved until the blade 1 finishes cutting the wafer W along the cutting line L1 and the blade 2 finishes cutting the wafer W along the cutting line L2 as shown in FIG. 9(C). Consequently, the wafer W is cut along two cutting lines L1 and L2 at the same time. Reference numeral 3 is a motor for the blade 1, and 4 is a spindle of the motor 3. Reference numeral 5 is a motor for the blade 2, and 6 is a spindle of the motor 5.

According to the cutting method for the conventional dicing machine, however, the wafer W cannot be cut along two cutting lines L1 and L2 at the same time unless the blades 1, 2 are moved over a wide area E enclosed by broken lines D in FIG. 9(C), because two blades 1, 2 are arranged in parallel. This causes the blades 1, 2 to move unnecessarily, and therefore it takes a long time to cut the wafer W. Moreover, strokes must be long along the X-axis, and therefore, the dicing machine is too wide.

SUMMARY OF THE INVENTION

The present invention has been developed in view of the above-described circumstances, and has as its object the provision of a workpiece cutting method for use with a dicing machine, which decreases unnecessary movements of the blades to thereby reduce the cutting time.

To achieve the above-mentioned object, the present invention is directed to a workpiece cutting method in a dicing machine comprising the steps of: cutting a workpiece along two cutting lines with a pair of blades at the same time while moving said pair of blades and said workpiece along the X-axis relatively to one another, said pair of blades being arranged oppositely at a predetermined interval along the Y-axis; after cutting the workpiece along said two cutting lines, moving said pair of blades by a pitch of cutting lines, thereby cutting the workpiece along the next two cutting lines at the same time; and repeating the cutting such that the workpiece is cut along the cutting lines sequentially.

To achieve the above-mentioned object, the present invention is directed to a workpiece cutting method in a dicing machine comprising the steps of: arranging a pair of blades oppositely along the Y-axis, setting an interval between said pair of blades at the total pitches of cutting lines on the workpiece, and moving said pair of blades and the workpiece along the X-axis relatively to one another, thereby cutting the workpiece along two cutting lines at both ends thereof at the same time; after cutting the workpiece along said two cutting lines, moving one blade of said pair of blades along the Y-axis by one pitch toward the other blade, and moving the other blade along the Y-axis by one pitch toward said one blade, thereby cutting the workpiece along the next two cutting lines at the same time; and repeating the cutting such that the workpiece is cut along the cutting lines sequentially.

According to the present invention, two blades are arranged oppositely at a predetermined interval along the Y-axis. The two blades cut the workpiece along two cutting lines at the same time while the two blades and the workpiece are moved along the X-axis relatively to one another. After the workpiece is cut along these two cutting lines, the two blades are moved along the Y-axis by one pitch of the cutting lines so that the workpiece can be cut along the next two cutting lines. This action is repeated to cut the workpiece along the cutting lines continuously. According to the present invention, the oppositely-arranged two blades cut the workpiece, thereby holding the relative movement along the X-axis to a minimum and reducing the cutting time.

According to the present invention, the workpiece is divided into a plurality of cutting areas, and each cutting area is sequentially cut along a plurality of cutting lines. This holds the relative movement along the X-axis to a minimum.

According to the present invention, two blades are arranged oppositely along the Y-axis, and they may be arranged at an interval of total pitches of cutting lines. The two blades and the workpiece are moved along the X-axis relatively to one another, and the two blades cut the workpiece along two cutting lines at both ends thereof at the same time. After the workpiece is cut along these two cutting lines, one of two blades is moved by one pitch along the Y-axis toward the other blade and the other blade is moved by one pitch along the Y-axis toward the one blade, so that the workpiece can be cut along the next two cutting lines. This action is repeated to cut the workpiece along cutting lines continuously. According to the present invention, the two blades are arranged oppositely, and thus, the relative movement along the X-axis is held to a minimum, and the cutting time is reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENT

This invention will be described in further detail by way of example with reference to the accompanying drawings.

Figure 1:
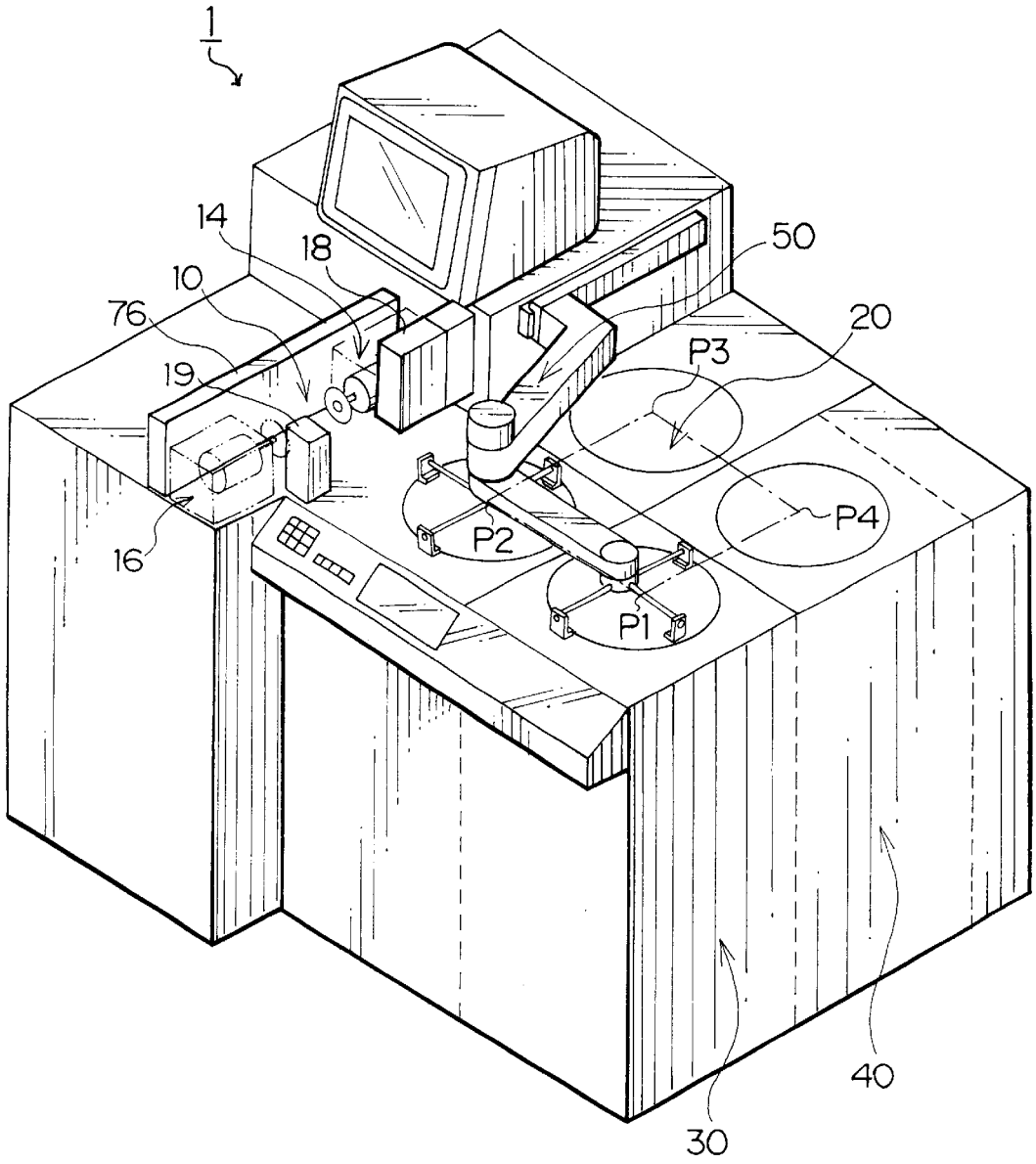
FIG. 1 is a perspective view of a dicing machine according to the present invention.

FIG. 1 is a perspective view of a dicing machine 1 which dices a semiconductor wafer according to the present invention. As shown in FIG. 1, the dicing machine 1 is comprised mainly of a cutting part 10, a cleaning part 20, a cassette housing part 30, an elevator part 40 and transport equipment 50.

Figure 2:
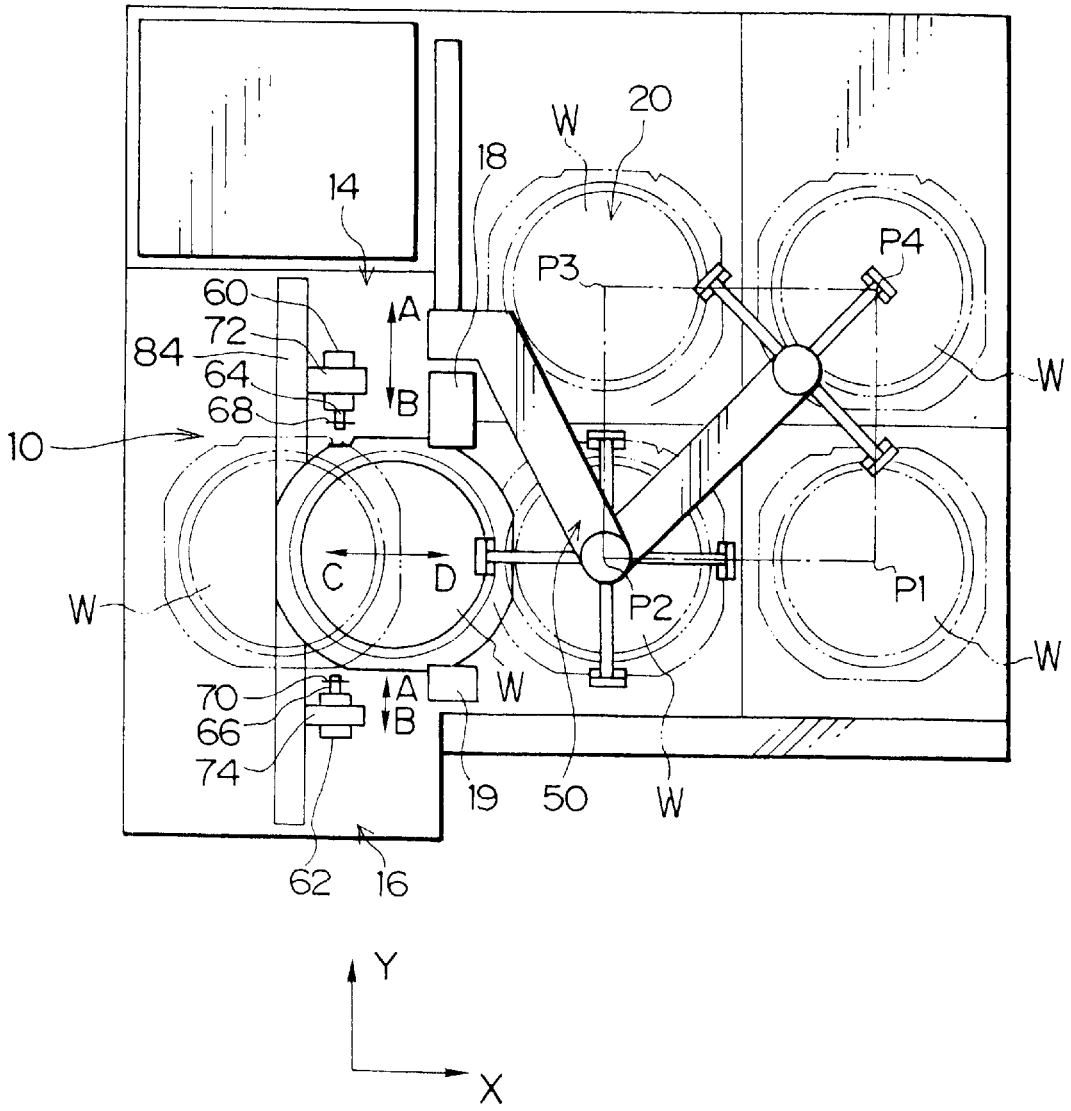
FIG. 2 is a plan view of the dicing machine in FIG. 1.

A description will be given of a cutting process of the dicing machine 1. First, a plurality of wafers W, which are housed in the cassette housing part 30, are sequentially retrieved by the elevator part 40, and the retrieved wafer W is set at a position P4 in FIG. 2. The wafer W is placed on a cutting table (position P2) 12 of the cutting part 10 via a pre-load stage at a position P1. The wafer W is held on the cutting table 12 by vacuum. Alignment part 18, 19 recognize patterns on the wafer W as images, and the wafer W is aligned in accordance with the recognition. The movement of the cutting part 10 along the Y-axis indicated by an arrow A-B and the movement of the cutting table 12 along the X-axis indicated by an arrow C-D cuts the aligned wafer W along two cutting lines at the same time. Then, spindles of the cutting part 10 are moved by a pitch of the cutting lines. The cutting table 12 is moved again along the X-axis so as to cut the wafer W along the next two cutting lines. The cutting is repeated. After the wafer W is cut along all the cutting lines in one direction (along the X-axis), the cutting table 12 is turned by 90° to cut the wafer W along cutting lines in the other direction (along the Y-axis in FIG. 2) perpendicular to the already-cut cutting lines. Consequently, the wafer W is cut into squares.

On completion of the cutting, the cutting table 12 moves to return the wafer W to the position P2, and the transport equipment 50 transports the wafer W to a spin table of the cleaning part 20 at the position P3. The wafer W is cleaned by cleaning water and is dried by air. The transport equipment 50 transports the dried wafer W to the position P4, and the elevator part 40 houses the wafer W in the cassette housing part 30.

Figure 3:
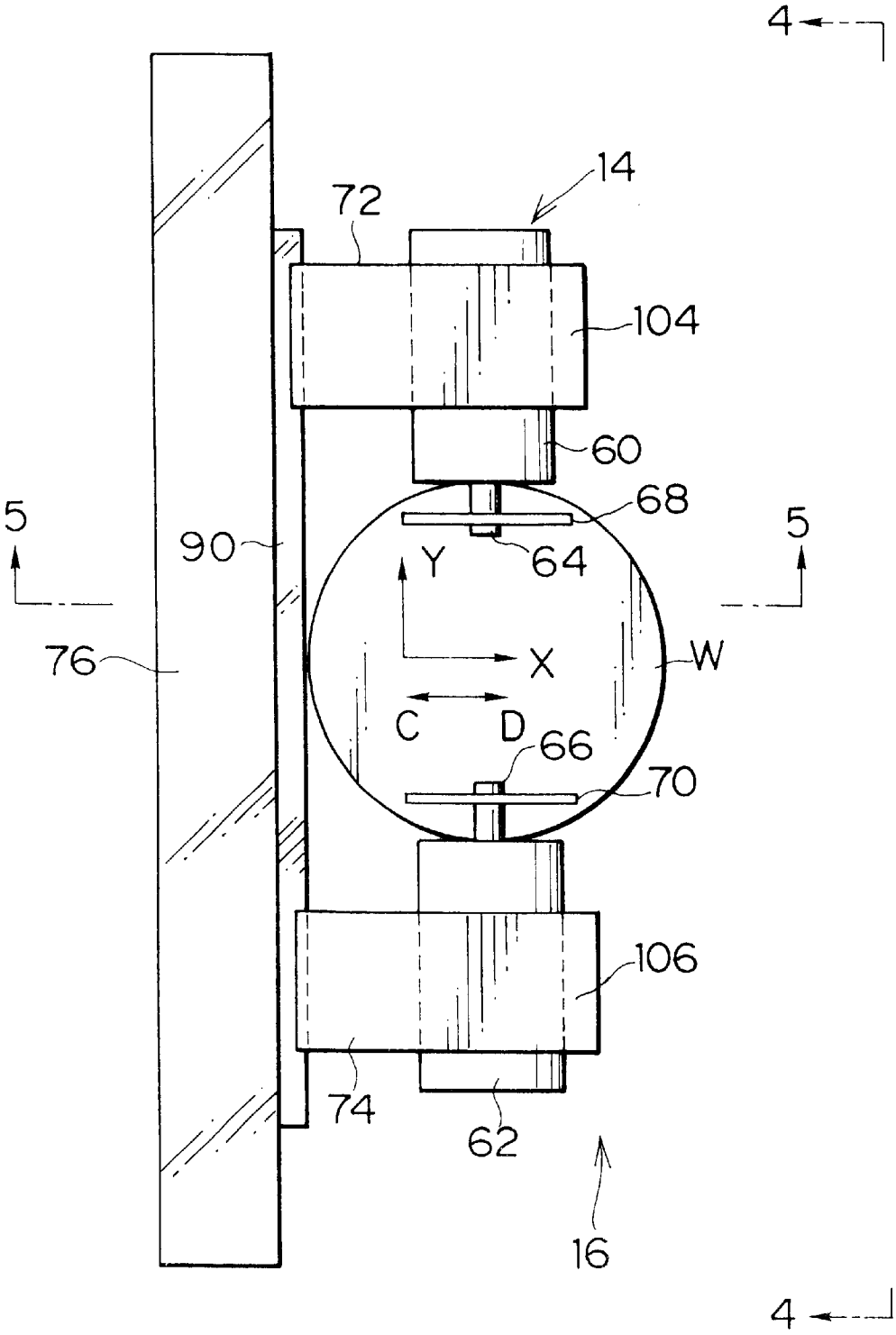
FIG. 3 is a plan view of the cutting part of a dicing machine.

A description will be given of the cutting part 10 of the dicing machine 1. FIG. 3 is a plan view of the cutting part 10. Cutting units 14, 16 of the cutting part 10 in FIG. 3 are provided with motors 60, 62; spindles 64, 66; and blades 68, 70 which are attached to the ends of the spindles 64, 66. A spindle movement mechanism moves the cutting units 14, 16 independently of one another along the Y-axis.

Figure 4:
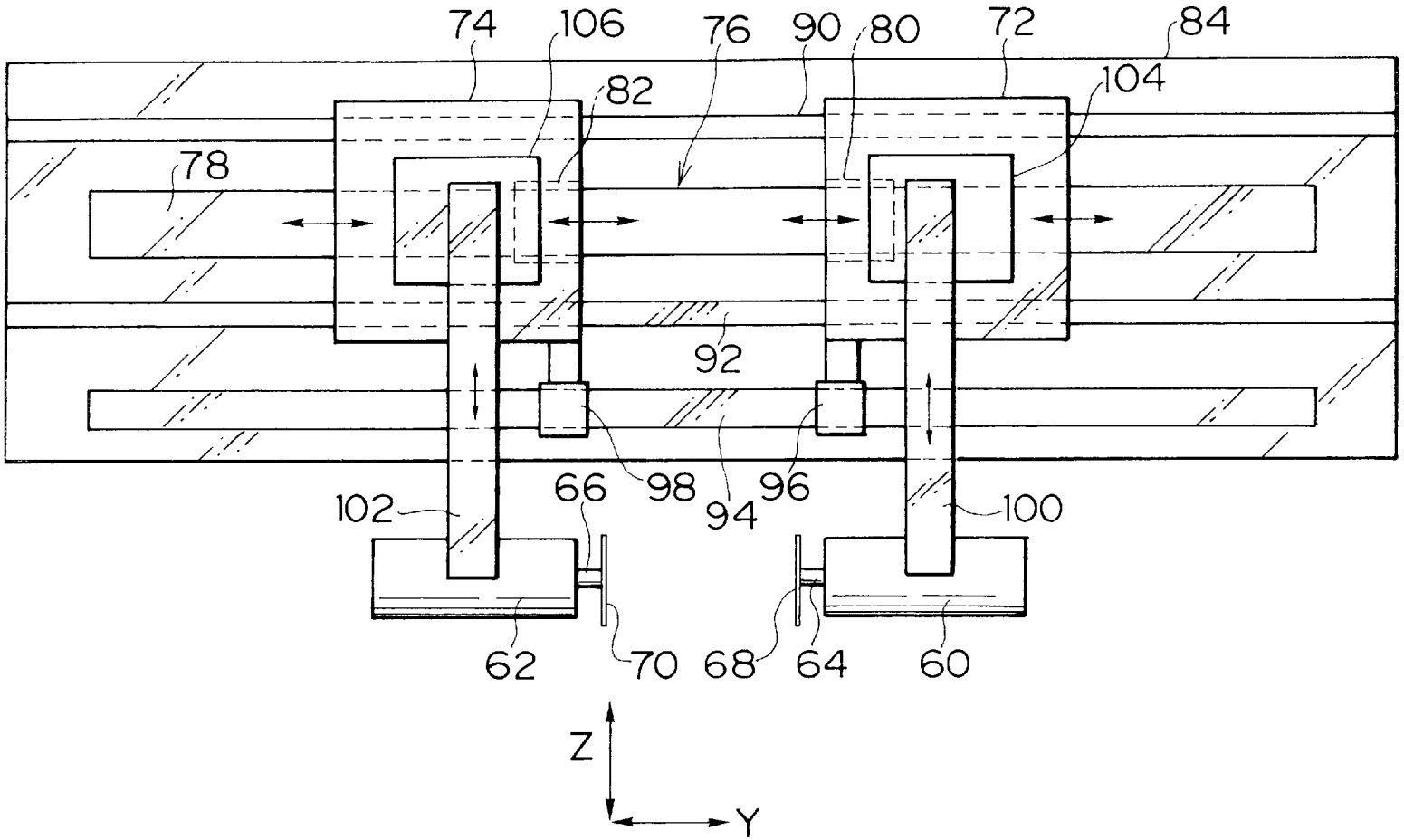
FIG. 4 is a side view of the cutting part taken along line 4—4 in FIG. 3.

As shown in FIG. 4, the spindle movement mechanism is comprised mainly of guide rails 90, 92 which guide carriages 72, 74 loaded with the motors 60, 62 along the Y-axis so that the carriages 72, 74 can move freely; and a linear motor 76 which moves the carriages 72, 74 along the Y-axis. The linear motor 76 consists of a magnet rail 78 and two coil assemblies 80, 82. The magnet rail 78 is secured to the side of a supporting plate 84 which is fixed to the dicing machine 1, and the magnet rail 78 is horizontal along the Y-axis. The coil assemblies 80, 82 are secured to the carriages 72, 74, respectively.

Figure 5:
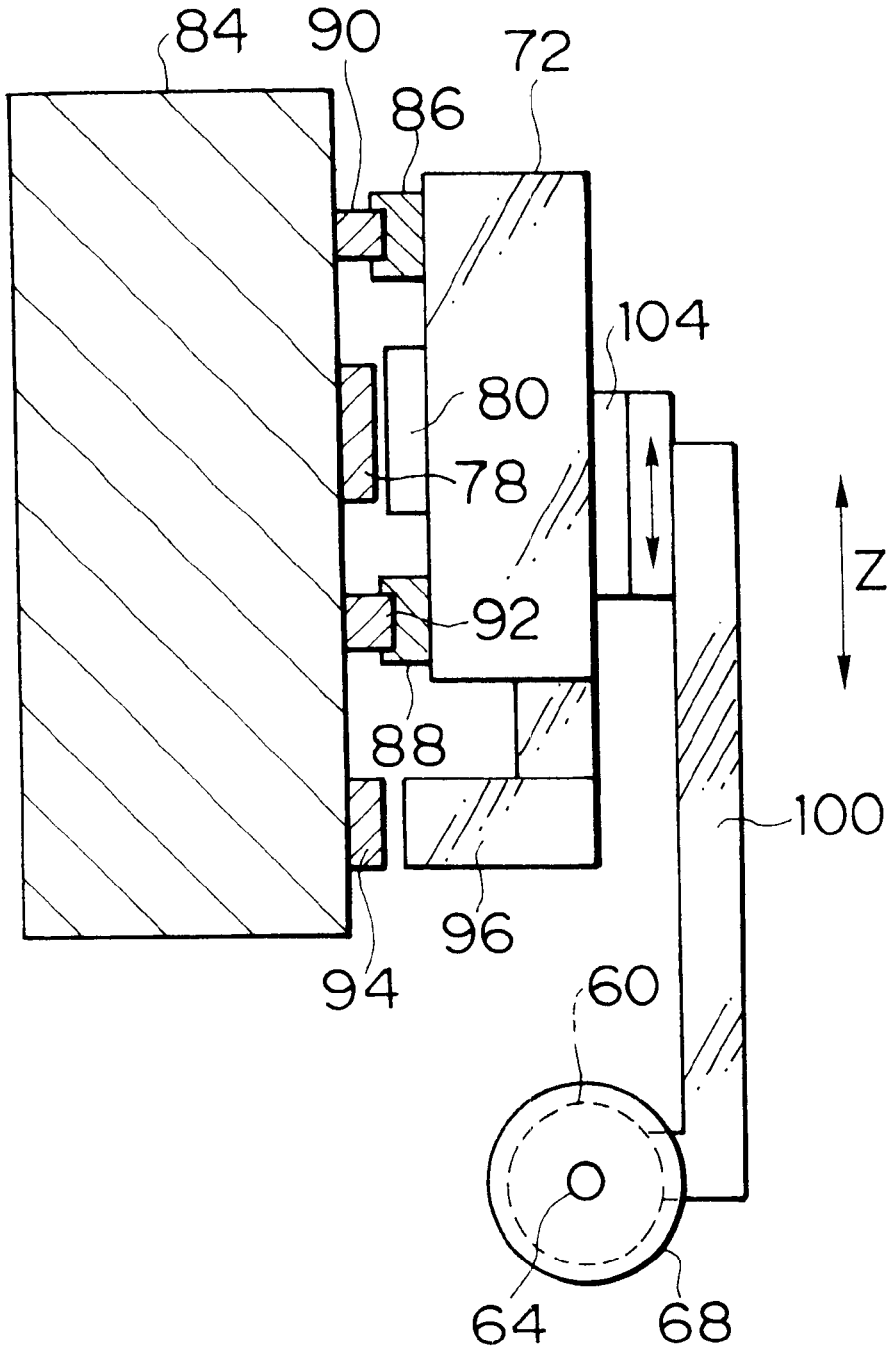
FIG. 5 is a longitudinal sectional view of the cutting part taken along line 5—5 in FIG. 3.

The magnet rail 78 is a fixed member of the linear motor, and the two coil assemblies 80, 82 are movable members of the linear motor. As shown in FIG. 5, the magnet rail 78 faces the coil assemblies 80, 82 at a predetermined interval (only one coil assembly 80 is illustrated in FIG. 5). Running the linear motor moves the carriages 72, 74 along a magnet rail 78 along the Y-axis independently of one another. The principle for running the linear motor is well known, and it will not be explained.

As shown in FIG. 5, two sliders 86, 88 are secured to the carriage 72. The sliders 86, 88 are provided at the upper side and lower side of the coil assembly 80. The slider 86 is slidably supported on a guide rail 90, and the slider 88 is slidably supported on a guide rail 92. Although not illustrated, two sliders are secured to the carriage 74 as is the case with the carriage 72. One slider is slidably supported on the guide rail 90, the other is slidably supported on the guide rail 92. The guide rails 90, 92 are fixed parallel to the magnet rail 78, and they function as a guide member for both carriages 72, 74.

A moire scale 94 of a linear encoder is attached to the supporting plate 84. The moire scale 94 detects the positions of detection pieces 96, 98 provided at the carriages 72, 74 in a non-contact state, thus indirectly detecting the positions of the blades 68, 70. The moire scale 94 is fixed parallel to the magnet rail 78. A control unit (not illustrated) feedback-controls the linear motor 76 in accordance with the information on the positions of the blades 68, 70, which is detected by the moire scale 94.

As shown in FIG. 4, the motors 60, 62 connect to the carriages 72, 74 through arms 100, 102 and Z-axis movement mechanisms 104, 106. Thus, driving the Z-axis movement mechanisms 104, 106 move the motors 60, 62 vertically along the Z-axis, resulting in the vertical movement of the blades 68, 70. Adjusting the descending amount of the blades 68, 70 by the Z-axis movement mechanisms 104, 106 sets the depth of cut for the wafer W.

A description will be given of the operation of the spindle movement mechanism of the dicing machine 1 which is constructed in the above-mentioned manner.

First, the linear motor 76 of the spindle movement mechanism is driven to set the interval between the two blades 68, 70 in FIG. 3. In this case, if the set value of the interval is input from an external input unit (not illustrated), a control unit (not illustrated) controls the linear motor 76 to move the carriages 72, 74 along the Y-axis. The moire scale 94 outputs the positional information about the blades 68, 70 to the control unit. The control unit feedback-controls the linear motor 76 in accordance with the positional information, thereby positioning the blades 68, 70 at the set value of the interval.

After the carriages 72, 74 are positioned, the Z-axis movement mechanisms 104, 106 are driven to move the blades 68, 70 downward to set the depth of cut of the wafer W. Then, the motor 60, 62 rotate the blades 68, 70 and move the cutting table along the X-axis, so that the blades 68, 70 can cut the wafer W along the first two cutting lines.

Then, the spindle movement mechanism moves the blades 68, 70 along the guide rails 90, 92 along the Y-axis by the pitch of the cutting lines. Then, the cutting table is moved again along the X-axis to cut the wafer W along the next two cutting lines. The cutting is repeated in this manner. After the wafer W is cut along all the cutting lines in the direction of the X-axis, the cutting table is turned by 90° so that the wafer W can be cut along cutting lines along the X-axis perpendicular to the already-cut cutting lines in the above-described manner. Consequently, the wafer W is cut into squares.

A description will be given of the method of cutting the wafer W according to this embodiment with reference to FIGS. 6, 7 and 8.

Figure 6:
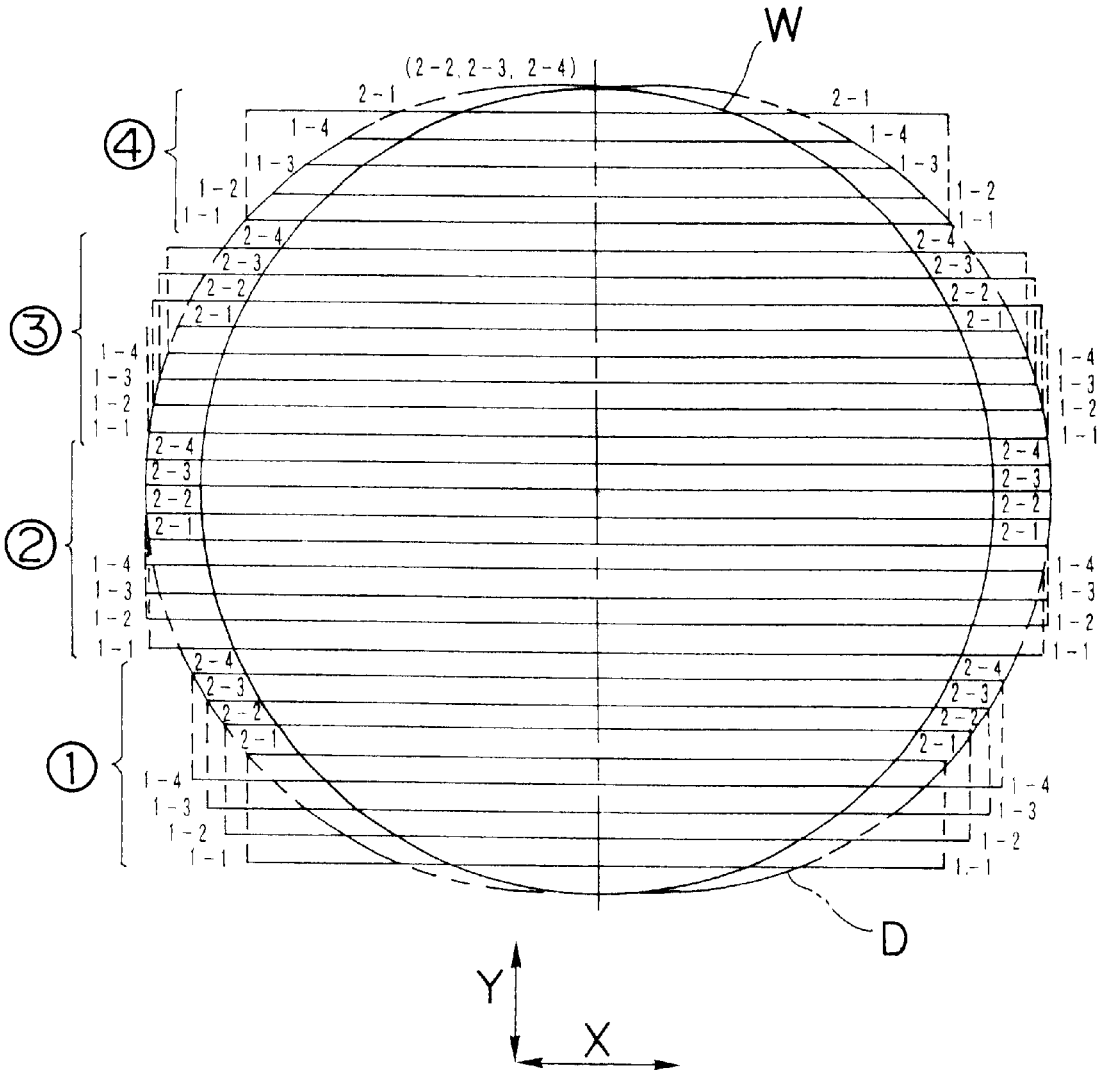
FIG. 6 is a view of assistance in explaining a first embodiment of a wafer cutting method.

FIG. 6 is a conceptional view of the procedure for cutting the wafer W. The cutting area of the wafer W is divided into areas ①, ②, ③ and ④, which are cut in numerical order along a plurality of cutting lines therein. Referring to FIG. 6, the blade 70 cuts each area along the cutting lines 1-1 first, and the blade 68 cuts each area along the cutting lines 2-1 first. In the case of the area ①, the blades 68, 70 are arranged at an interval of four pitches, and the blades 68, 70 cut the area along the 2-1 cutting line and the 1-1 cutting line, respectively, at the same time.

Next, the spindle movement mechanism shifts the blades 68, 70 by one pitch of the cutting line without changing the interval between the blades 68, 70. Then, the blades 68, 70 cut the cutting lines 2-2 and 1-2, respectively, at the same time. This action is repeated two more times, and the area ① is cut along eight cutting lines.

After the area ① is cut along all the cutting lines, the areas ② and ③ are cut along eight cutting lines for each in the above-mentioned manner. The area ④ has five cutting lines. The blades 68, 70 cut the area along the cutting line 2-1 and 1-1, respectively, at the same time, and only the blade 70 cuts the area along the cutting lines 1-2 to 1-4 sequentially. Consequently, the wafer W is cut along all the cutting lines along the X-axis.

In the above-mentioned method, the wafer W can be cut along the cutting lines by shifting the blades 68, 70 at constant pitches without changing the interval between the blades 68,70. For this reason, the positions of the blades 68, 70 can be controlled easily. In addition, it is possible to prevent the contamination of the wafer W due to the concentration of cutting points. The cutting direction (X) of the wafer W may be either one-way or two-way.

Figure 7:
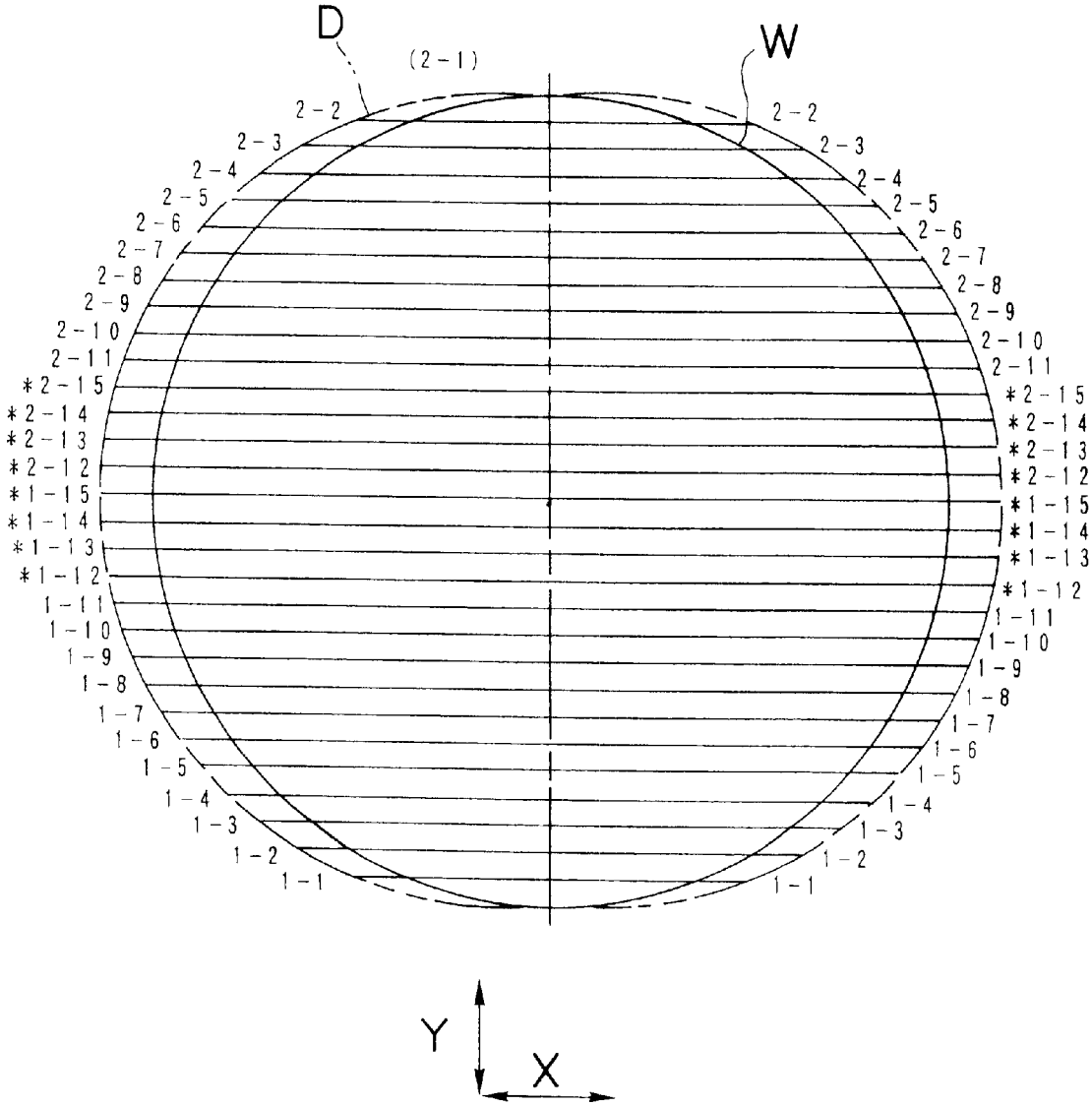
FIG. 7 is a view of assistance in explaining a second embodiment of a wafer cutting method.

Referring to FIG. 7, the two blades cut the wafer W at the same time. The blade 70 cuts the cutting lines 1-1 to 1-15 sequentially, and the blade 68 cuts the cutting lines 2-1 to 2-15 sequentially. In this cutting method, the interval between the blade 68 and the blade 70 is set at the total pitches. The blades 68, 70 cut the cutting lines 2-1 and 1-1, respectively, at the same time.

Then, the blade 68 is moved toward the blade 70 by one pitch, and the blade 70 is moved toward the blade 68 by one pitch. The blade 70 cuts the cutting line 1-2, and the blade 68 cuts the cutting line 2-2. This action is repeated nine more times. The wafer W is cut along the remaining eight cutting lines in the cutting method described with reference to FIG. 6. Specifically, the blade 68 and the blade 70 are arranged at an interval of four pitches. The blade 70 cuts wafer W along the cutting lines 1-12 to 1-15 and the blade 68 cuts the wafer along the cutting lines 2-12 to 2-15 at the same time.

In the above-mentioned method, the wafer W is cut sequentially from the cutting lines at both ends thereof up to the cutting lines at the center thereof, and thus, the wafer can be cut along the cutting lines without being influenced by the tension of a tape. The wafer W, which is cut by the dicing machine 1, is normally adhered to a frame through the tape which is tensioned. For this reason, as the wafer W is cut along the cutting lines, the wafer W can be shifted due to a restitutive force of the tape. In this case, even if the blades 68, 79 are moved by one pitch, the blades 68, 70 fail to come into contact with the next cutting lines and they cut chips. The cutting method in FIG. 7 eliminates the above-mentioned disadvantages. Specifically, the wafer W subject for cutting is not shifted even though the cut pieces of the wafer are shifted by the restitutive force of the tape. Consequently, the wafer W can be cut along the cutting lines without fail.

Figure 8:
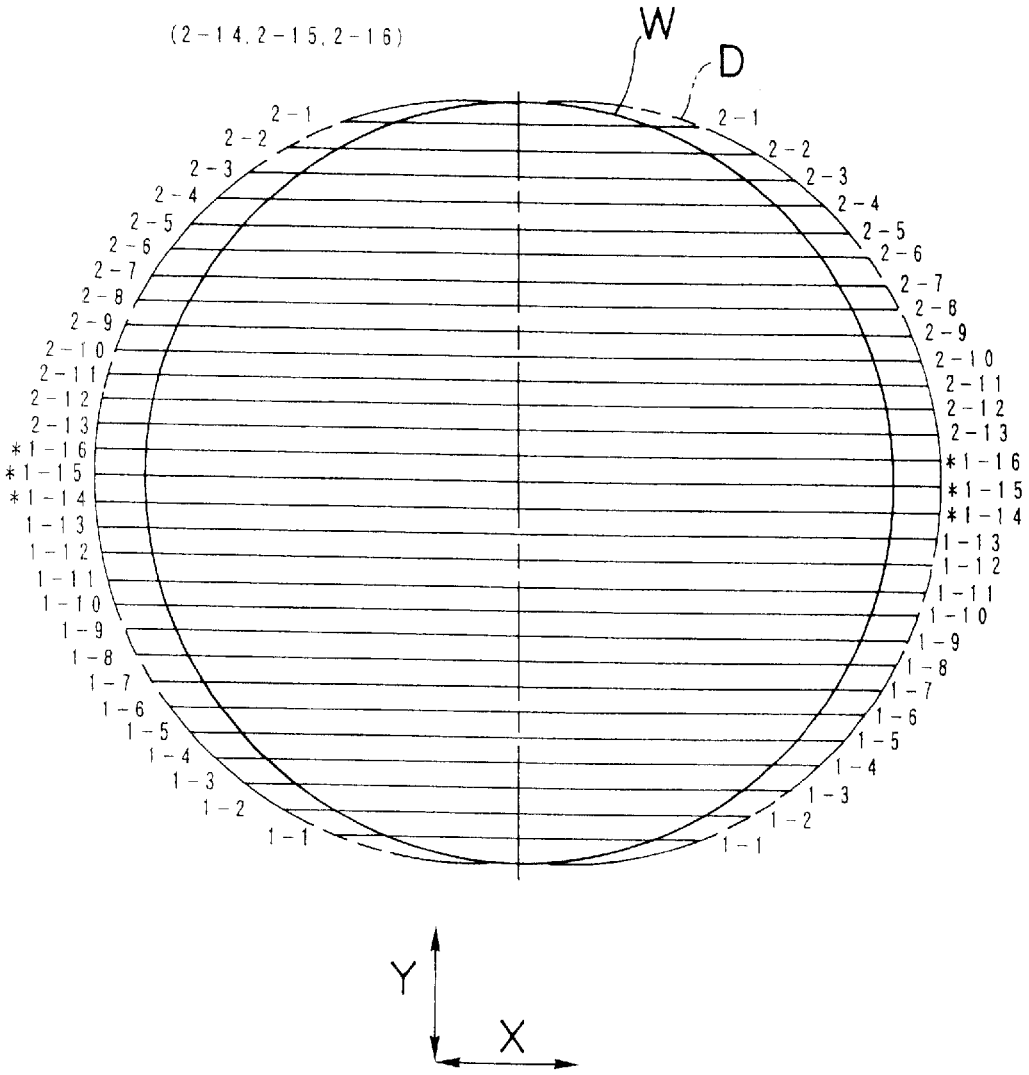
FIG. 8 is a view of assistance in explaining a third embodiment of a wafer cutting method.
Figure 9:
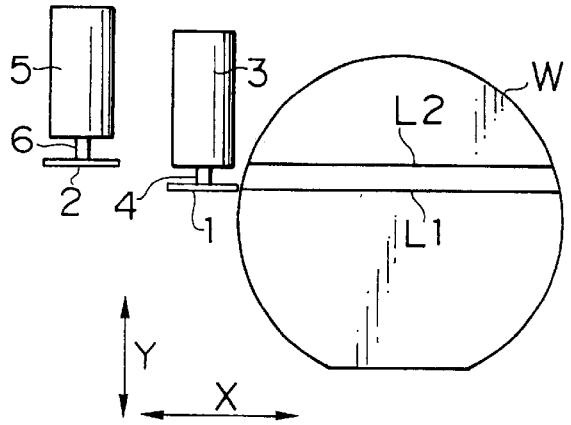
FIG. 9 (A) (Prior Art)
FIGS. 9(A), 9(B) and 9(C) are transitional views showing a workpiece cutting method for use with a conventional dicing machine.
Figure 9:
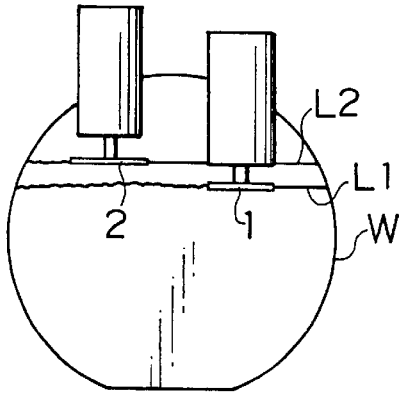
FIG. 9 (B) (Prior Art)
Figure 9:
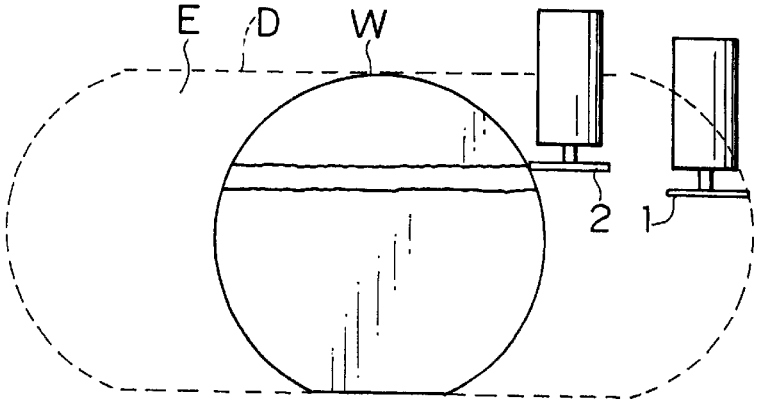
FIG. 9 (C) (Prior Art)

In the cutting method in FIG. 8, the two blades 68, 70 cut the wafer W at the same time. The blade 70 cuts the cutting lines 1-1 to 1-13 sequentially, whereas the blade 68 cuts the cutting lines 2-1 to 2-13 sequentially. The blade 70 cuts the wafer W along the remaining three cutting lines 1-14 to 1-16.

In the above cutting method, the blades 68, 70 are closest to one another when the three cutting lines 1-14 to 1-16 are remaining. At this time, the two blades 68, 70 cannot cut the cutting lines 1-14 to 1-16 at the same time, and therefore one blade (the blade 70 in this embodiment) cuts the cutting lines 1-14 to 1-16 sequentially.

As set forth hereinabove, the workpiece cutting method of this embodiment can hold the movement along the X-axis to a minimum. Consequently, the wafer W can be cut in a short period of time. Holding the movement along the X-axis to a minimum reduces the area in which the blades 68,70 move (the area enclosed by broken lines D in FIGS. 6, 7 and 8) as much as possible. This increases the life of the blades 68, 70 and extends the dressing period.

The workpiece cutting method may also be applied to full cutting, half cutting, semi-full cutting, and cutting by different blades (a wafer W is cut two times or more along the same cutting lines).

As set forth hereinabove, according to the workpiece cutting method used with the dicing machine of the present invention, the oppositely-arranged two blades cut the workpiece, thus holding the relative movement along the X-axis to a minimum and reducing the workpiece cutting time.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A workpiece cutting method in a dicing machine comprising the steps of:

dividing a workpiece into a plurality of cutting areas having a defined plural number of parallel cutting lines extending along an X-axis;

sequentially cutting each cutting area by, for each cutting area:

cutting the workpiece simultaneously along a first pair of cutting lines with a pair of blades while moving the pair of blades and the workpiece relative to one another along the X-axis, said pair of blades being arranged oppositely at a predetermined interval along a Y-axis that is perpendicular to the X-axis, said interval corresponding to the sum of the pitch distances of half of said defined plural number of cutting lines;

after cutting the workpiece along the first pair of cutting lines, moving each of said pair of blades by one cutting line pitch in the same direction, and cutting the workpiece simultaneously along a second pair cutting lines; and repeating the steps of moving each of the blades by a cutting line pitch and cutting the workpiece along pairs of cutting lines until all of cutting lines of the cutting area have been sequentially cut from the workpiece.

2. A workpiece cutting method in a dicing machine comprising the steps of:

providing a workpiece with a plurality of cutting lines extending parallel to an X-axis, adjacent cutting lines being spaced from each other in a Y-axis direction by a pitch distance with a distance between first and last cutting lines in said Y-axis direction being equal to a sum of the pitch distances;

arranging a pair of blades opposite each other along a Y-axis, setting an interval between said pair of blades in said Y-axis direction that is equal to the distance between the first and last cutting lines, said first and last cutting lines being at a respective end of the workpiece;

cutting the workpiece along said first and last cutting lines at the same time by moving the pair of blades relative to the workpiece in an X-axis direction; moving each of the blades toward the other of the blades along the Y-axis by one pitch distance and then cutting the workpiece along said an inwardly next two cutting lines at the same time by moving the pair of blades relative to the workpiece in an X-axis direction;

repeating said moving of the blades and then cutting the workpiece until said blades are spaced by a predetermined number of pitch distances and then re-setting the distance between the blades to a relative spacing in the Y-axis direction which is equal to a sum of the pitch distances of half of a number of remaining cutting lines, and positioning said blades at first and second of the remaining cutting lines;

cutting the workpiece along said first and second cutting lines at the same time by moving the pair of blades relative to the workpiece in an X-axis direction;

moving each of the blades in the same direction along the Y-axis by one pitch distance and then cutting the workpiece along a next two adjacent cutting lines at the same time by moving the pair of blades relative to the workpiece in an X-axis direction; and repeating said moving of the blades in the same direction along the Y-axis and then cutting the workpiece along a next two adjacent cutting lines at the same time until the workpiece has been cut along all of the remaining cutting lines.

3. A workpiece cutting method in a dicing machine comprising the steps of:

providing a workpiece with a plurality of cutting lines extending parallel to an X-axis, adjacent cutting lines being spaced from each other in a Y-axis direction by a pitch distance with a distance between first and last cutting lines in said Y-axis direction being equal to a sum of the pitch distances;

arranging a pair of blades opposite each other along a Y-axis, setting an interval between said pair of blades in said Y-axis direction that is equal to the distance between the first and last cutting lines, said first and last cutting lines being at a respective end of the workpiece;

cutting the workpiece along said first and last cutting lines at the same time by moving the pair of blades relative to the workpiece in an X-axis direction; moving each of the blades toward the other of the blades along the Y-axis by one pitch distance and then cutting the workpiece along said an inwardly next two cutting lines at the same time by moving the pair of blades relative to the workpiece in an X-axis direction;

repeating said moving of the blades and then cutting the workpiece until said blades are spaced a predetermined distance from each other and then using only one of said pair of blades for cutting all of cutting lines which remain uncut.

* * * * *